United States Patent [19]

Fluck

[11] Patent Number: 4,832,167

[45] Date of Patent: May 23, 1989

[54] METHOD AND APPARATUS FOR GROUPING ARTICLES

[75] Inventor: René Fluck, Schleitheim, Switzerland

[73] Assignee: SIG Schweizerische Industrie-Gesellschaft, Neuhausen am Rheinfall, Switzerland

[21] Appl. No.: 639,452

[22] Filed: Aug. 9, 1984

[30] Foreign Application Priority Data

Aug. 15, 1983 [CH] Switzerland ..... 4447/83

[51] Int. Cl.[4] ..... B65G 47/26

[52] U.S. Cl. ..... 198/419.1; 198/426; 414/796

[58] Field of Search ..... 198/425, 426; 414/48, 414/114, 115, 126, 330

[56] References Cited

U.S. PATENT DOCUMENTS

| | | | |
|---|---|---|---|
| 2,555,816 | 6/1951 | Rhodes et al. | 198/425 |
| 3,127,029 | 3/1964 | Luginbuhl | 198/425 |
| 3,451,563 | 6/1969 | Luginbuhl | 414/330 |
| 3,811,549 | 5/1974 | Preisig | 198/425 |
| 3,930,572 | 1/1976 | Fluck et al. | 198/425 |
| 4,098,392 | 7/1978 | Greene | 198/425 |
| 4,462,515 | 7/1984 | Fischer | 198/426 |

FOREIGN PATENT DOCUMENTS

| | | | |
|---|---|---|---|
| 77753 | 4/1983 | European Pat. Off. | 198/425 |
| 1561431 | 3/1970 | Fed. Rep. of Germany | 198/425 |
| 3244013 | 7/1983 | Fed. Rep. of Germany | 198/425 |
| 1476915 | 4/1967 | France | 198/425 |
| 2259769 | 8/1975 | France | 198/425 |
| 165619 | 12/1981 | Japan | 198/425 |
| 476598 | 9/1969 | Switzerland . | |
| 527093 | 10/1972 | Switzerland . | |
| 873337 | 7/1961 | United Kingdom | 198/425 |
| 1298171 | 11/1972 | United Kingdom | 414/115 |

*Primary Examiner*—Robert J. Spar
*Assistant Examiner*—D. Glenn Dayoan
*Attorney, Agent, or Firm*—Spencer & Frank

[57] ABSTRACT

An apparatus for separating article groups from a stream of flat articles, comprises an inclined chute on which a stream of flat articles arranged in an edgewise standing, face-to-face oriented, stacked relationship are advanced, an article group receiving arrangement situated downstream of the chute, a pickup base arranged for movement from a discharge end of the chute along the article group receiving arrangement while being in a face-to-face contact with an advancing leading article; a separating gate arranged for introduction between two adjoining articles of the article stream and a common drive for moving the pickup base parallel to the direction of article advance and for moving the separating gate, during displacement of the pickup base, away from the chute, from a point above the chute along a path of displacement that causes the separating gate to penetrate progressively between two adjoining articles of the article stream as the article stream advances.

6 Claims, 3 Drawing Sheets

METHOD AND APPARATUS FOR GROUPING ARTICLES

BACKGROUND OF THE INVENTION

This invention relates to a method and an apparatus for separating article groups of predetermined length from a stream of articles which are of flat wafer or disc-like configuration and which are edgewise and face-to-face oriented. The apparatus is of the type wherein the articles are guided in a downwardly inclined channel and the forwardly-oriented face of the leading article of each group is engaged by a pickup base which permits forward movement of the leading article—and the group—parallel to itself. The group length is determined by introducing a separating gate into the article stream, between two articles upstream of the leading articles.

Apparatuses of the above-outlined type are known wherein a string (stack) of articles is advanced through a predetermined distance and then, by means of grippers, it is braked at a distance from an abutment. The length of the article string (group of articles) is thus predetermined and is subsequently further processed, for example, packaged. Such an arrangement is disclosed, for example, in U.S. Pat. No. 3,037,610.

Instead of braking the articles, U.S. Pat. No. 3,811,549 teaches the introduction of a separating gate into the article stream between two adjoining articles to thus stop the article stream behind (upstream of) the separating gate.

Further, Swiss Patent No. 476,598 teaches to guide disc or wafer-like flat articles, such as confectionary items in a stacked manner in a downwardly inclined channel to thus cause their downward sliding. In the channel recesses are provided and a clamping rail is applied with a slight pressure against a number of items to thus press such items against an oppositely lying wall surface. Downstream of the clamping rail there is provided a separating device which has three holding elements arranged for engaging three sides of the article.

It was found, however, that none of the above-outlined known apparatuses can handle delicate articles such as confectionary items in a gentle manner if these known apparatuses are to operate at high output speeds. In particular, a braking of the upstream arranged articles by means of brake shoes has been found to be disadvantageous and also, a transverse introduction of a separating gate involves a high risk of damaging the delicate articles.

SUMMARY OF THE INVENTION

It is an object of the invention to provide an improved method and apparatus to handle delicate articles in a gentle and reliable manner in a fast-operating machine.

This object and others to become apparent as the specification progresses, are accomplished by the invention, according to which, briefly stated, the pickup base is moved along the downwardly inclining article path with a velocity which is unidirectional with but greater than the velocity of the article stream and further, a separating gate is, at least along a major part of its separating path, shifted synchronously with the pickup base and simultaneously, as the article stream advances, is caused to penetrate progressively between two adjoining articles in the stream.

DESCRIPTION OF THE PREFERRED EMBODIMENT

Figure 1:
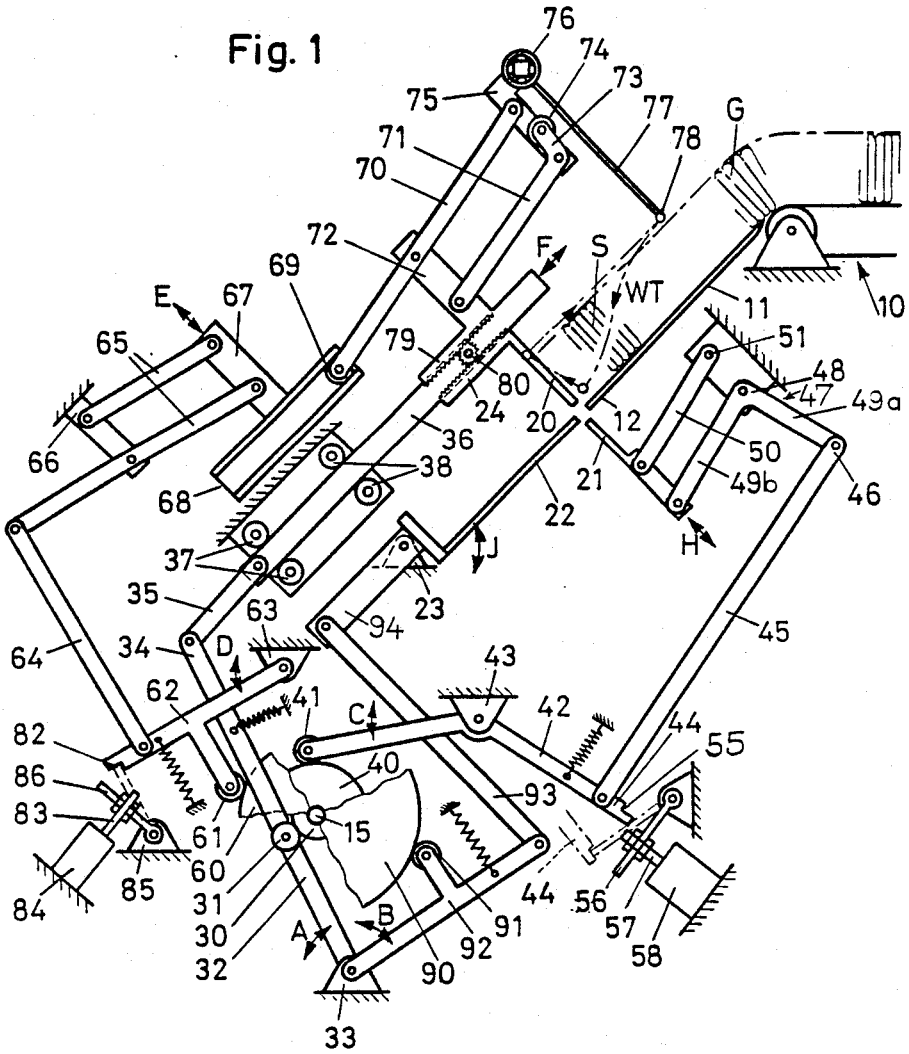
FIG. 1 is a schematic side elevational view of a preferred embodiment of the invention.

Turning to FIG. 1, an intake belt 10 carries articles G, such as flat confectionary items, in an edge-wise standing, face-to-face relationship to the upstream end of a downwardly inclined channel or chute 11. The articles are fed from a baking oven to the feed belt 10 and arranged thereon as disclosed in Swiss Patent No. 527,093. The articles are, as a continuous stack S transferred from the conveyor belt 10 onto the channel or chute 11. The inclination of the chute 11 may have an angle of 20°–70° to the horizontal dependent upon frictional and height level relationships. It is noted that in FIG. 1 lateral guide faces or carrier elements are omitted for the sake of clarity of illustration.

On the chute 11 the articles G slide downwardly to the pickup base 20 where they accumulate in a stack in a known manner.

FIG. 1 shows the pickup base 20 in its uppermost upstream position at the downstream (discharge) end 12 of the chute 11. At the same location, there are arranged a hold-back device 21 and a depositing shovel 22. The latter constitutes an at least approximately linear continuation of the chute 11. The depositing shovel 22 is rotatably supported by means of a pivot 23 mounted on the machine frame. By means of this arrangement, the depositing shovel 22 may be pivoted from its shown upper terminal position into a lower terminal position where the articles supported thereon in a group of predetermined length are deposited to a conveyor device (not shown) for further advancing the group, for example, to a packing machine as disclosed, for example, in U.S. Pat. No. 3,037,610.

Conventional driving mechanisms with cam discs and followers are provided for driving the pickup base 20, the hold-back component 21 and the depositing shovel 22. A first cam disc 30 effects a translational motion of the pickup base 20. Since the pickup base 20 is in its uppermost upstream end position shown in FIG. 1, an associated follower 31 is situated at that point of the cam disc 30 which is closest to the disc axis. The follower 31 is mounted on a pivotal lever 32 which executes a motion in the direction of the arrow A by virtue of its pivotal support 33 attached to the machine frame. To the other end 34 of the lever 32 there is articulated an equalizing lever 35 which, in turn, is jointed to a push rod 36. The latter is guided for translational motion by means of two roller pairs 37 and 38 supported in the machine frame. The pickup base 20 is connected with the push rod 36 for longitudinal displacement as it will be discussed in more detail later.

A second cam disc 40 is engaged by a follower 41 which is mounted on a two-armed pivotal lever 42. The latter is pivotally supported on the machine frame by means of a pivot 43. Thus, the follower 41 executes a motion in the direction of the arrow C and is shown in FIG. 1 as being situated at a location on the cam disc 40 closest to the cam disc axis. At the other end 44 the two-armed pivotal lever 42 is articulated to a push rod 45 whose other end 46 is, in turn, jointed to one arm 49*a* of a bell crank lever 47 which is pivotally supported in the machine frame at its angle 48. The other arm 49*b* of the bell crank lever 47 is articulated to the hold-back component 21. A link 50 is articulated to the hold-back component 21 and to the machine frame at 51 such that the link 50 and the arm 49 form a parallelogram linkage. The hold-back component 21 thus is allowed to execute solely a translational motion parallel to its length dimension in the direction of the arrow H.

The end 44 of the two-armed pivotal lever 42 has a stepped recess 55. A lever 56 pivotally held in the machine frame is connected with an armature 57 of an actuator 58 such as a hydraulic cylinder or a solenoid. As shown in phantom lines, the pivotal lever 42 may thus be held stationary in one extreme pivotal position so that the hold-back component 21 continuously extends into the path of the articles G and thus blocks the advance of the stack S.

A third cam disc 60 is engaged by a follower 61 mounted on a lever 62 which is pivotally held at 63 in the machine frame for motion in the direction of the arrow D. This motion is transmitted by means of a bar 64 to one of two parallel rods 65. The two parallel rods 65 are rotatably held by a pivot block 66 mounted on the machine frame so that a lifting rod 67 may, at the free end of the two parallel rods 65, execute strokes accurately along its own longitudinal axis in the direction of the arrow E.

On the lifting rod 67 there is mounted a guide rail 68 which thus too, is moved in the direction of the arrow E and in which there is guided a roller 69 secured to one of two parallel bars 70, 71. The two parallel bars 70, 71 are articulated to a shifting support 72 and to a carrier support 75. The latter resiliently holds a separating gate 77 with the intermediary of a coil spring 76.

The two parallel bars 70 and 71 are two-armed levers. The bar 70 is, at its driven side, extended beyond the shifting support 72 whereas the rod 71 is extended, remote from the shifting support 72 in an angled manner and carries a pressing roller 74. By means of this arrangement the insertion roller 78 at the end of the separating gate 77 executes a stroke in the direction of the arrow E and in the last portion of its insertion stroke the pressing roller 74 pushes against the separating gate 77 and causes an excursion thereof, against the force of the spring 76, in a direction against the stack S, whereby a space is provided for inserting the hold-back component 21 and the speed of the separating gate 77 is reduced with respect to that of the pickup base 20.

Thus, the separating gate 77 is moved, on the one hand, with the push rod 36, together with the pickup base 20, parallel to the arrow F and, in addition, is also moved parallel to the arrow E, so that the insertion roller 78 describes the resultant path WT shown in dashed lines.

On the push rod 36 there is mounted a pinion 80 which meshes with a toothed rack 79 integral with the shifting support 72 and a toothed rack 24 integral with the pickup base 20. By rotating the pinion 80, the shifting support 72 and the pickup base 20 are moved in opposite directions, whereby the distance between the pickup base 20 and the separating gate 77 may be varied. In this manner the length of the article group may be arbitrarily adjusted.

The lever 62 is provided with a recess 82 which is similar to the recess 55 of the lever 42. By means of an armature 83 of an actuator 84 a lever 86 can be displaced underneath the recess 82 by swinging motion about a pivot 85 secured to the machine frame so that the stroke of the separating gate 77, similarly to the stroke of the hold-back component 21 may be interrupted.

A fourth cam disc 90 is engaged by a follower 91 which is mounted on a lever 92 swingable about pivot 33 attached to the machine frame. The lever 92 is articulated to a rod 93 which, in turn, is jointed to a bar 94 which is a rigid continuation of the depositing shovel 22. This mechanism pivots the depositing shovel 22 about the pivot 23 in the direction of the arrow J.

The four cam discs 30, 40, 60 and 90 affixed to a common drive shaft 15 effect a synchronous motion of the pickup base 20, the hold-back component 21, the depositing shovel 22 and the separating gate 77 as illustrated in four phases in respective FIGS. 2, 3, 4 and 5. The displacement/time relationship of these displacements is illustrated in the diagram of FIG. 6.

Turning now to FIGS. 2, 3, 4 and 5, there are shown therein the pickup base 20, the hold-back component 21, the depositing shovel 22 and the separating gate 77 with the insertion roller 78 and the pressing roller 74. FIG. 6 illustrates one cycle of motion of these elements (that is, one revolution of the shaft 15 which supports the four cam discs 30, 40, 60 and 90). The revolution of the shaft 15 is indicated along the abscissa (it also designates the time relationship), while the displacement of the components, designated with their respective reference numerals, is indicated along the ordinate. The directions of motion E, F, H and J shown in FIG. 6 are those illustrated in FIG. 1.

In the description which follows, the operation of the above-described apparatus will be set forth with reference to FIGS. 2–6.

Figure 2:
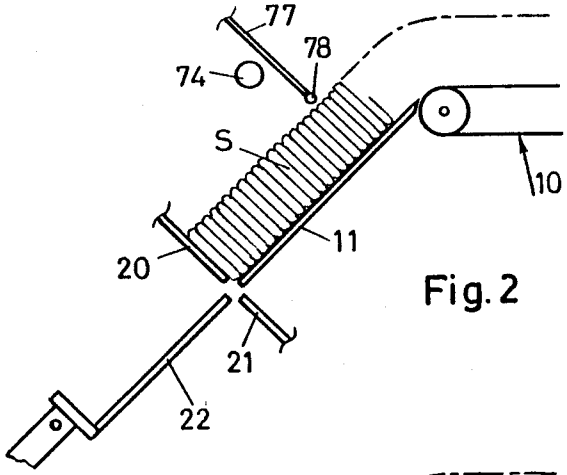

The conveyor belt 10 advances articles G with a velocity V10 to the inclined chute 11 so that, according to FIG. 2, behind the pickup base 2 a stack S is formed. According to the uppermost curve I in FIG. 6, the pickup base 20 and the separating gate 77 are moved in the direction F with a velocity which is greater than the velocity V10. At the same time, the separating gate 77, as shown by the curve III in FIG. 6, moves in the direction E.

Figure 3:
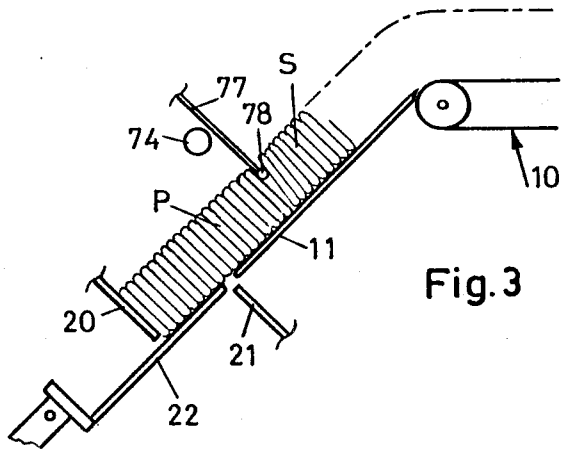
FIGS. 2, 3, 4 and 5 are schematic side elevational views of some components of the structure shown in FIG. 1, illustrating different phases of operation.

Since the pickup base 20 is moved faster than the supply speed of the articles G, there is achieved a pressure relief and thus the separating gate 77 may penetrate easily between two adjoining articles as shown in FIG. 3.

Figure 4:
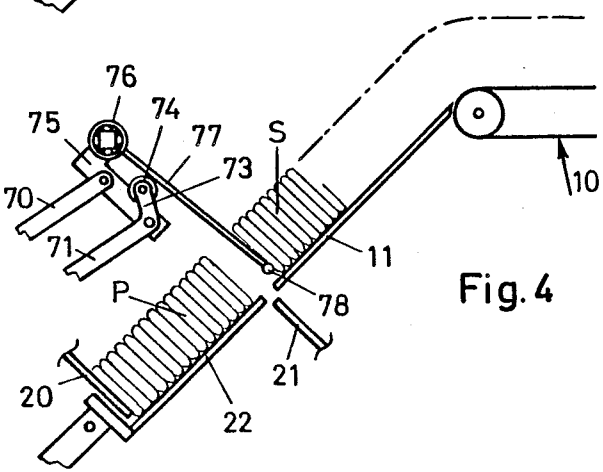

After the entire group P is situated on the depositing shovel 22, the pressing roller 74 retains the separating gate 77 at a slight distance as may be seen in FIG. 4 and indicated by the curve I (FIG. 6) in which the path of the separating gate 77 is shown in solid lines and the path of the pickup base 20 is shown in broken lines.

Figure 5:
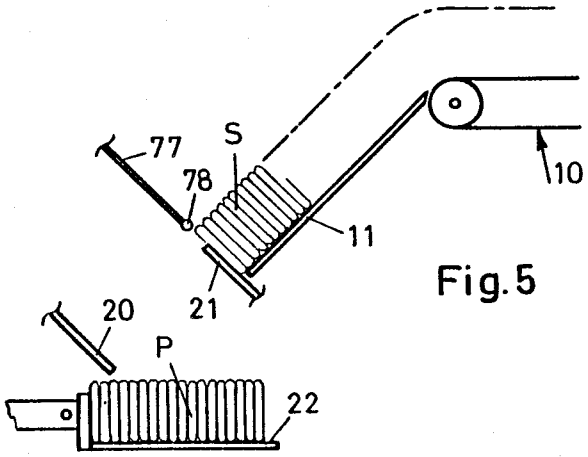
Figure 6:
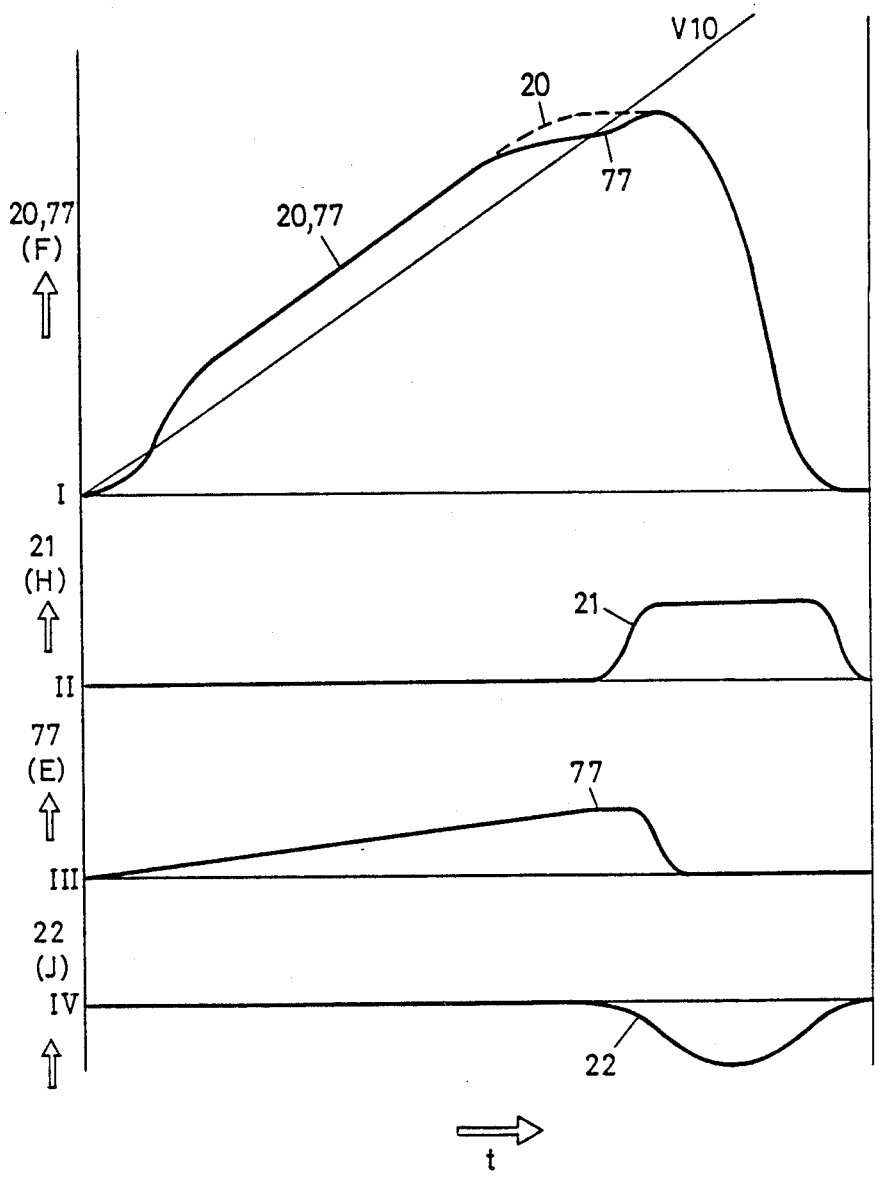
FIG. 6 illustrates a diagram showing the displacement/time function of different components.

At that time, as shown in FIG. 5, the hold-back component 21 is moved upwardly whereas the depositing shovel 22 is pivoted downwardly to a position where the article group P is removed in known manner. Since the stack S according to FIG. 5 is retained by the hold-back component 21, the pickup base 20 and the separating gate 77 are brought back into their initial position as shown in FIG. 1.

It will be understood that the above description of the present invention is susceptible to various modifications, changes and adaptations, and the same are intended to be comprehended within the meaning and range of equivalents of the appended claims.

What is claimed is:

1. An apparatus for sequentially separating article groups of predetermined length from a stream of flat articles, comprising:

(a) an inclined chute for guiding thereon a stream of flat articles moved by gravity in a direction of advance and arranged in an edgewise standing, face-to-face oriented, stacked relationship, said chute having a discharge end;

(b) an article group receiving means arranged downstream of said discharge end as viewed in the direction of advance of the articles;

(c) a pickup base arranged for movement from said discharge end of said chute along said article group receiving means while being in a face-to-face contact with an advancing leading article;

(d) a separating gate arranged for introduction between two adjoining articles of the article stream for determining the length of an article group to be separated from the article stream; said separating gate being at a distance from said pickup base;

(e) a common driving means for moving said pickup base and said separating gate together back and forth parallel to said direction of advance and for moving said separating gate, during displacement of said pickup base in said direction of advance, from a point above said chute along a path of displacement having a first motion component whose direction coinciding with said direction of advance and a second motion component whose direction being perpendicular to said direction of advance and oriented towards said chute, whereby said separating gate is caused to penetrate progressively between two adjoining articles of the article stream as said article stream moves in said direction of advance and (f) setting means for arbitrarily adjusting said distance, whereby the length of the article group is varied at will, 2. An apparatus as defined in claim 1, wherein said common driving means includes a parallelogram linkage having a link to which said separating gate is articulated; said link being situated above said chute and being oriented there toward; said common driving means including means for moving said parallelogram linkage parallel to said direction of advance and for simultaneously moving said link towards or away from said chute.

3. An apparatus as defined in claim 2, wherein said link is a first link; said parallelogram linkage including a second link formed as a bell crank lever having a free end; said bell crank lever being articulated to an end of said first link; further comprising a pressing roller mounted on said free end of said bell crank lever; spring means for urging said pressing roller against said separating gate during a terminal portion of said displacement path for displacing said separating gate against said direction of advance to reduce the speed of said separating gate and to cause said separating gate to exert a retaining force on said article stream upstream of a group of articles separated by said separating gate.

4. An apparatus as defined in claim 1, further comprising means for reducing the speed of motion of the separating gate relative to the speed of motion of the pickup base at least along a terminal portion of the path of displacement of said separating gate in the direction of advance of the articles.

5. In a method of sequentially separating article groups of predetermined length from a stream of flat articles advancing in an edgewise standing, face-to-face oriented stacked relationship, including the steps of causing the articles to slide downwardly on an inclined chute in a direction of advance; moving a pickup base, while in a face-to-face contact with a surface of a leading article of the article stream, in said direction of advance for guiding the leading article and the stream of articles upstream thereof parallel to themselves in said direction of advance; and introducing a separating gate into the article stream transversely to said direction of advance at a predetermined distance upstream from the leading article for determining the length of the article group to be separated from the article stream, the improvement comprising the following cyclically repetitive steps:

(a) moving said pickup base above said chute in said direction of advance at a speed higher than that of the article stream;

(b) simultaneously with step (a), moving said separating gate from a point above said chute along a path of displacement having a first motion component whose direction coinciding with said direction of advance and a second motion component whose direction being perpendicular to said direction of advance and being oriented towards said chute, whereby said separating gate is caused to penetrate progressively between two adjoining articles of the article stream as said article stream moves in said direction of advance;

(c) simultaneously with step (b), reducing the speed of motion of the separating gate relative to that of the pickup base at least along a terminal portion of the path of displacement of said separating gate;

(d) simultaneously with step (c), moving a hold-back component in front of a new leading article of the article stream immediately upstream of the article group separated by said separating gate;

(e) removing the article group from the article stream;

(f) reversing the direction of motion of said pickup base and said separating gate and returning, in synchronism, the pickup base and the separating gate against the direction advance into a starting position and (g) maintaining said hold-back component at the new leading article until said pickup base and said separating gate have reached said starting position.

6. An apparatus for sequentially separating article groups of predetermined length from a stream of flat articles, comprising:

(a) an inclined chute for guiding thereon a stream of flat articles moved by gravity in a direction of advance and arranged in an edgewise standing, face-to-face oriented, stacked relationship; said chute having a discharge end;

(b) an article group receiving means arranged downstream of said discharge end as viewed in the direction of advance of the articles;

(c) a pickup base arranged for movement from said discharge end of said chute along said article group receiving means while being in a face-to-face contact with an advancing leading article;

(d) a separating gate arranged for introduction between two adjoining articles of the article stream for determining the length of an article group to be separated from the article stream; said separating gate being at a distance from said pickup base;

(e) a common driving means for moving said pickup base and said separating gate together back and forth parallel to said direction of advance and for moving said separating gate, during displacement of said pickup base in said direction of advance, from a point above said chute along a path of displacement having a first motion component whose direction coinciding with said direction of advance and a second motion component whose direction being perpendicular to said direction of advance and oriented towards said chute, whereby said separating gate is caused to penetrate progressively between two adjoining articles of the article stream as said article stream moves in said direction of advance; said common driving means comprising a push rod and a shifting support operatively coupled to said separating gate; and (f) setting means for arbitrarily adjusting said distance, whereby the length of the article group is varied at will; said setting means comprising a first toothed rack on said shifting support, a second toothed rack on said pickup base and pinion rotatably mounted on said push rod and meshing, at diametrically opposite locations thereof, with said first and second toothed racks for effecting opposite simultaneous linear displacements of said pickup base and said separating gate upon turning said pinion.

* * * * *